US007614370B2

(12) United States Patent
Fischer et al.

(10) Patent No.: US 7,614,370 B2
(45) **Date of Patent: *Nov. 10, 2009**

(54) VANE-TYPE CAM PHASER HAVING BIAS SPRING SYSTEM TO ASSIST INTERMEDIATE POSITION PIN LOCKING

(75) Inventors: Thomas H. Fischer, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 88 days.

This patent is subject to a terminal disclaimer.

(21) Appl. No.: 11/447,437

(22) Filed: Jun. 6, 2006

(65) Prior Publication Data

US 2007/0277757 A1 Dec. 6, 2007

(51) Int. Cl.
*F01L 1/34* (2006.01)

(52) U.S. Cl. ..... 123/90.15; 123/90.17; 123/90.65; 464/160

(58) Field of Classification Search ..... 123/90.15, 123/90.16, 90.17, 90.18, 90.65, 90.66, 90.67; 464/1, 2, 160

See application file for complete search history.

(56) References Cited

U.S. PATENT DOCUMENTS 5,056,477 A * 10/1991 Linder et al. ..... 123/90.17
5,172,662 A * 12/1992 Hampton ..... 123/90.17
6,276,321 B1 * 8/2001 Lichti et al. ..... 123/90.17
6,336,433 B1 * 1/2002 Anton et al. ..... 123/90.17
6,405,695 B2 * 6/2002 Mizutani et al. ..... 123/90.17
6,439,184 B1 * 8/2002 Takenaka et al. ..... 123/90.17
6,450,138 B1 * 9/2002 Kinugawa et al. ..... 123/90.17
6,505,586 B1 * 1/2003 Sato et al. ..... 123/90.17
6,732,690 B2 * 5/2004 Pierik et al. ..... 123/90.17
7,146,946 B2 * 12/2006 Yudate et al. ..... 123/90.17
7,225,774 B2 * 6/2007 Watanabe et al. ..... 123/90.17
7,363,897 B2 * 4/2008 Fischer et al. ..... 123/90.17

OTHER PUBLICATIONS

Cuatt, Daniel R. and Fischer, Thomas H.,; pending U.S. Appl. No. 11/225,772, entitled, "Vane-Type Cam Phaser Having Increased Rotational Authority, Intermediate Position Locking and Dedicated Oil Supply", filed with the U.S. Patent & Trademark Office on Sep. 13, 2005.

* cited by examiner

*Primary Examiner*—Ching Chang
(74) *Attorney, Agent, or Firm*—Thomas N. Twomey

(57) ABSTRACT

A vane-type camshaft phaser for varying the timing of combustion valves in an internal combustion engine includes a seat formed in the sprocket at the appropriate position of intermediate rotation and a locking pin slidably disposed in a vane of the rotor for engaging the seat to lock the rotor at the intermediate position. A bias spring system disposed on a cover plate urges the rotor toward the locking position from any position retarded of the locking position. A first spring system embodiment comprises a pair of compression spring assemblies. A second spring system embodiment comprises an internal torsion spring. In each embodiment, the phaser may be assembled without having the spring system coupled to the rotor, thereby overcoming a rotor cocking problem inherent in prior art phasers, assuring reliable mounting of an assembled phaser onto an engine camshaft.

5 Claims, 4 Drawing Sheets

VANE-TYPE CAM PHASER HAVING BIAS SPRING SYSTEM TO ASSIST INTERMEDIATE POSITION PIN LOCKING

TECHNICAL FIELD

The present invention relates to vane-type camshaft phasers for varying the phase relationship between crankshafts and camshafts in internal combustion engines; more particularly, to such phasers wherein a locking pin assembly is utilized to lock the phaser rotor with respect to the stator at certain times in the operating cycle; and most particularly, to a phaser having a bias spring system to assist in locking a phaser rotor at a rotational position intermediate between full phaser advance and full phaser retard positions.

BACKGROUND OF THE INVENTION

Camshaft phasers for varying the phase relationship between the crankshaft and a camshaft of an internal combustion engine are well known. A prior art vane-type phaser generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve (OCV), in accordance with an engine control module, to either the advance or retard chambers as required to meet current or anticipated engine operating conditions.

In a typical prior art vane-type cam phaser, a locking pin, disengage-able by oil pressure, is slidingly disposed in a bore in a rotor vane to permit rotational locking of the rotor to the stator (or sprocket wheel or pulley) under certain conditions of operation of the phaser and engine. In older prior art phasers, it is desired that the rotor be locked at its parked position at an extreme of the rotor authority, either at the full retard position as in the case of an intake camshaft phaser or at the full advance position as in the case of an exhaust camshaft phaser. To assist in positioning the rotor for lock pin engagement, it is known to incorporate a mechanical stop for the rotor and a torsional bias spring acting between the rotor and the stator to urge the rotor against the stop for locking.

In newer prior art phasers as disclosed in co-pending application having Ser. No. 11/225,772, it is desirable that the rotor be lockable to the stator at an intermediate position, preferably within an increased rotor range of rotational authority. A known problem in such phasers is that there is no mechanical means such as a stop to assist in positioning the rotor for locking in an intermediate position; thus, locking is not reliable, and an unacceptably high rate of locking failures may occur.

Further, in prior art phasers, the torsion spring may generate an unwanted torque on the rotor about an axis orthogonal to the rotor axis, causing the rotor to become slightly cocked within the stator chamber before the phaser is installed onto the end of a camshaft during engine assembly. This cocking is permitted by necessary clearances between the rotor and the stator. Although relatively slight, such cocking can be large enough to prohibit entry of the camshaft into the rotor during engine assembly.

What is needed in the art is an improved vane-type camshaft phaser having additional range of rotational authority wherein the rotor may be reliably locked to the stator at an intermediate position within the range of authority.

What is further needed in the art is an improved vane-type camshaft phaser wherein the rotor of an assembled phaser may be reliably entered onto the end of a camshaft during engine assembly.

It is a principal object of the present invention to cause a rotor lock pin to be properly positioned for engagement with a stator.

It is a further object of the present invention to increase the reliability of entry of the rotor of an assembled phaser onto an engine camshaft during engine assembly.

SUMMARY OF THE INVENTION

Briefly described, a vane-type camshaft phaser in accordance with the invention for varying the timing of combustion valves in an internal combustion engine includes a rotor having a plurality of vanes disposed in a stator having a plurality of lobes, the interspersion of vanes and lobes defining a plurality of alternating valve timing advance and valve timing retard chambers with respect to the engine crankshaft. The rotational authority of the rotor within the stator with respect to top-dead-center of the crankshaft is preferably between about 40 crank degrees before TDC (valve timing advanced) and about 20 crank degrees after TDC (valve timing retarded). It is generally desirable that an engine be started at a camshaft position of about 10 crank degrees valve retard. Thus, an improved phaser in accordance with the present invention includes a lock pin seat formed in the stator at the appropriate position of intermediate rotation and a locking pin slidably disposed in a vane of the rotor for engaging the seat to lock the rotor at the intermediate position for engine starting.

A pre-loaded bias spring system disposed on the phaser cover plate urges the rotor toward the locking position from any rotational position retarded of the locking position. When the rotor is moving in a phase-advance direction, at or near the rotor locking position the bias spring system becomes disengaged from the rotor. When the rotor is moving in a phase-retard direction, at or near the rotor locking position the bias spring system is engaged, causing the rotor to decelerate and thereby increasing the reliability of locking.

Two embodiments of such a bias spring system are presented, one comprising a torsion spring and the other comprising a pair of compression springs. In each embodiment, the phaser may be assembled without having the spring system coupled to the rotor, thereby overcoming the rotor cocking problem inherent in prior art phasers and assuring reliable mounting of an assembled phaser onto a camshaft during engine assembly.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
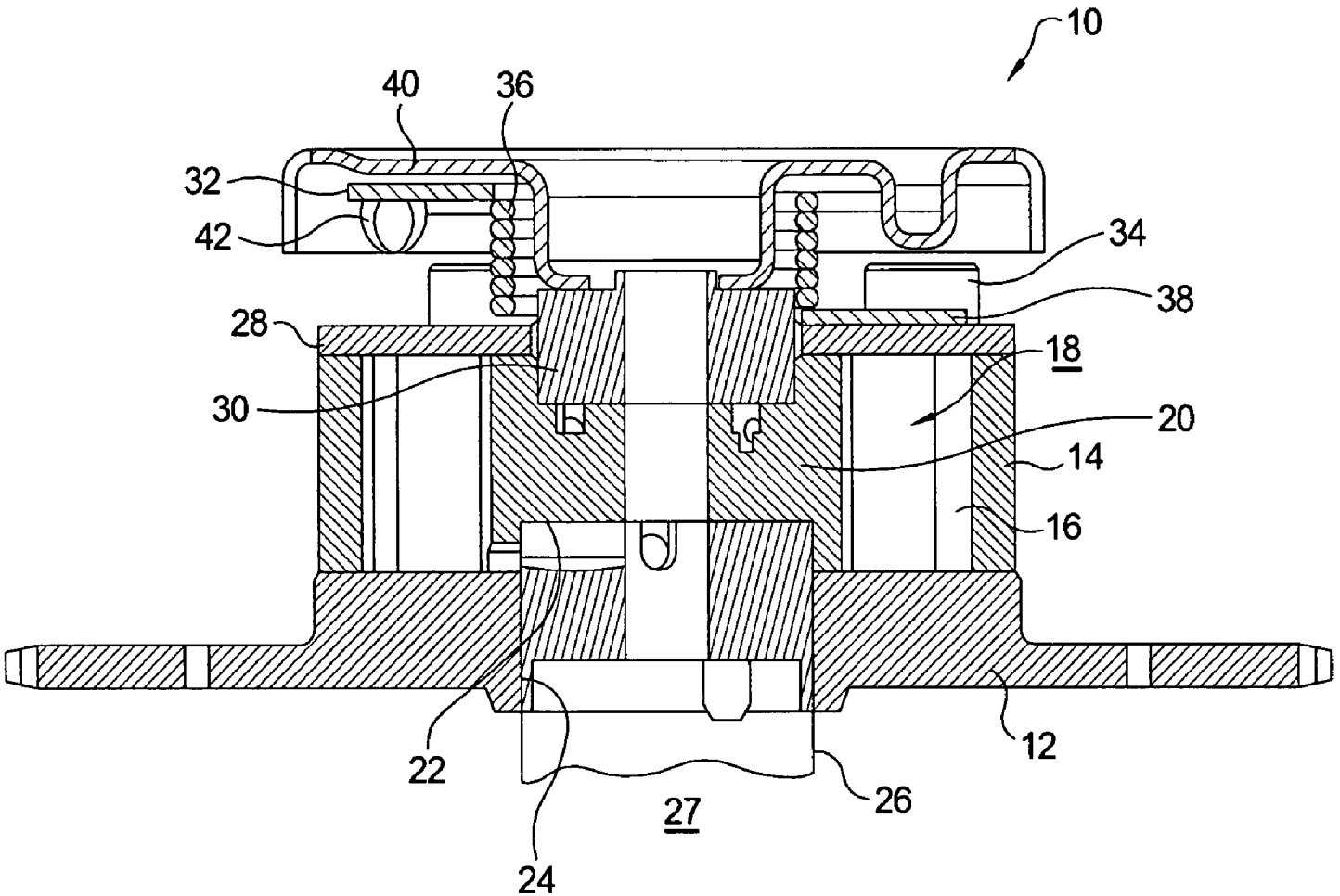
FIG. 1. (PRIOR ART)
FIG. 1 is an elevational cross-sectional view of a prior art vane-type camshaft phaser, showing direct entry of an engine camshaft into a rotor, and also showing an internal torsion bias spring for biasing the rotor to a fully retarded position within the stator.

Referring to FIG. 1, a typical prior art vane-type camshaft phaser 10 includes a pulley or sprocket 12 for engaging a timing chain or belt (not shown) operated by an engine crankshaft (not shown). A stator 14 is disposed against pulley/sprocket 12 and is rotationally immobilized with respect to pulley/sprocket 12. Stator 14 is provided with a central chamber 16 for receiving a rotor 18 having a hub 20. Hub 20 is provided with a recess 22 that is coaxial with a central bore 24 in pulley/sprocket 12, allowing access of an end of engine camshaft 26 into rotor hub 20 during mounting of phaser 10 onto an internal combustion engine 27 during assembly thereof. Central chamber 16 is closed by a cover plate 28, forming advance and retard chambers between the rotor and the stator in chamber 16. A rotor hub extension 30 is pressed into a recess in rotor hub 20 and extends rotatably through a central opening in cover plate 28. A target wheel 32 is mounted onto rotor hub extension 30 by an axial mounting bolt (not shown) that attaches phaser 10 to camshaft 26 during assembly of engine 27. Thus target wheel 32 turns with and is indicative of the rotational position of rotor 18 and camshaft 26. Cover plate 28 and stator 14 are secured to pulley/sprocket 12 via a plurality of binder screws 34 extending through stator 14 outside of chamber 16. A torsional bias spring 36 is disposed coaxially of rotor hub extension 30, having a first tang 38 anchored to sprocket/pulley 12, as for example, by engagement with the protruding head of a binder screw 34, and having a second tang 40 anchored to rotor 18, as for example, by engagement with a stop 42 on target wheel 32. Bias spring 36 is pre-loaded between the rotor and stator during assembly of phaser 10 to urge rotor 18 toward the full operational retard position within chamber 16, thereby causing the rotor cocking problem described above.

Figure 1A:
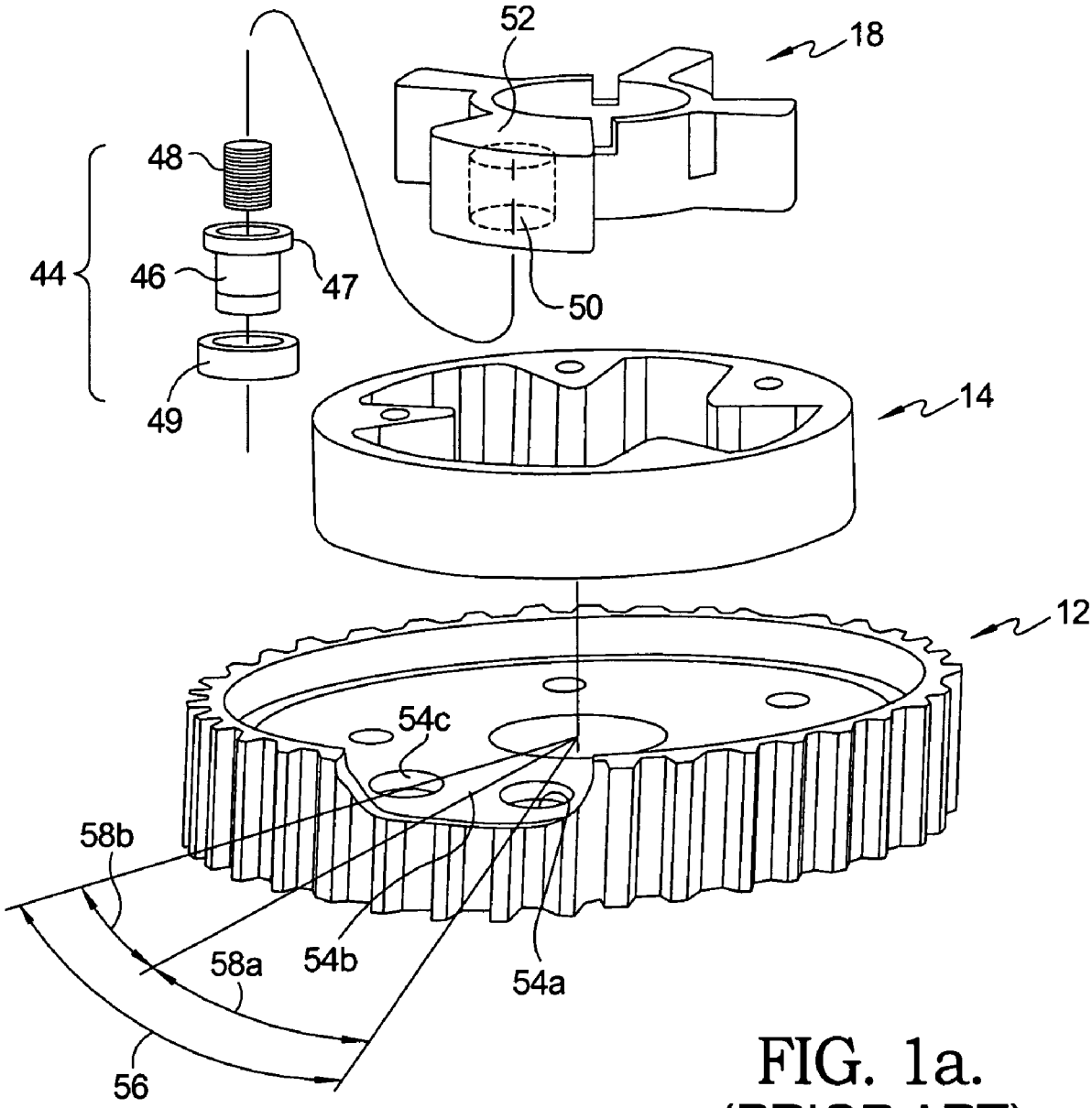
FIG. 1a. (PRIOR ART)
FIG. 1*a* is an exploded isometric view of a partial cam phaser including the pulley/sprocket, the stator, the rotor and the locking pin mechanism.

Referring now to FIG. 1*a*, locking pin mechanism 44 comprises locking pin 46 having annular shoulder 47, return spring 48, and bushing 49. Spring 48 is disposed inside pin 46, and bushing, pin, and spring are received in a longitudinal bore 50 formed in oversized vane 52 of rotor 18, an end of pin 46 being extendable by spring 48 from the underside of the vane. A pin seat 54 is formed in the inside surface of pulley/sprocket 12 for receiving an end portion of pin 46 when extended from bore 50 to rotationally lock rotor 18 to pulley/sprocket 12 and, hence, stator 14. The operation of locking mechanism 44 is described in co-pending application Ser. No. 11/225,772. Note that, by angularly positioning bore 54 on the inside surface of pulley/sprocket 12, within the range of rotational authority 56 of rotor 18, engagement of the locking mechanism can cause the rotor to be locked in its full retard position (54*a*), its full advance position (54*c*), or any intermediate position (54*b*) therebetween.

Figure 3:
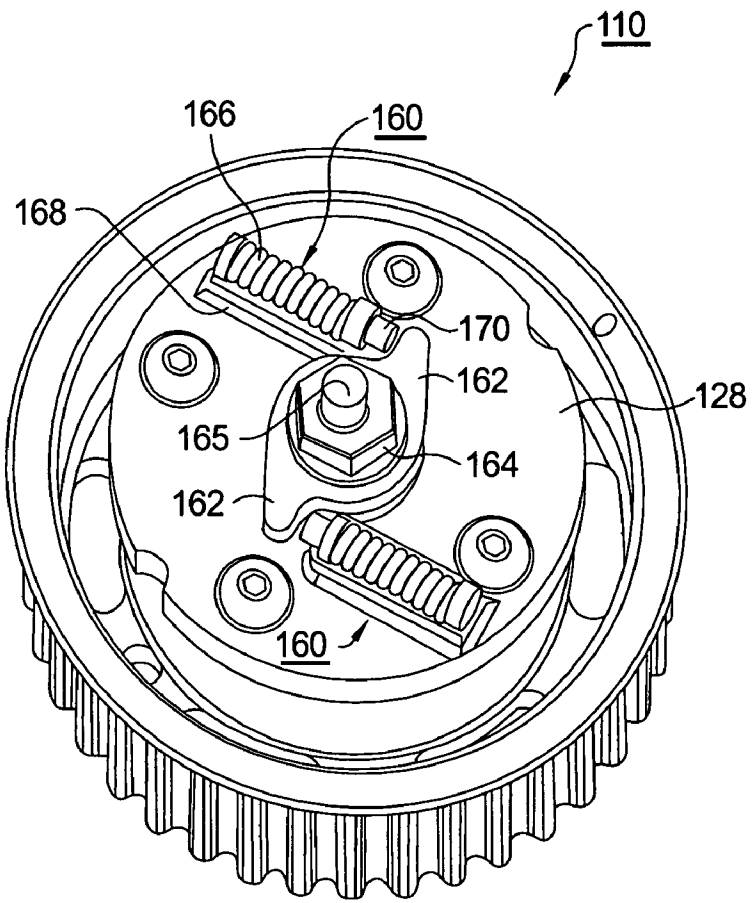
FIG. 3 is an isometric view of the phaser and bias spring system shown in FIG. 2.
Figure 2:
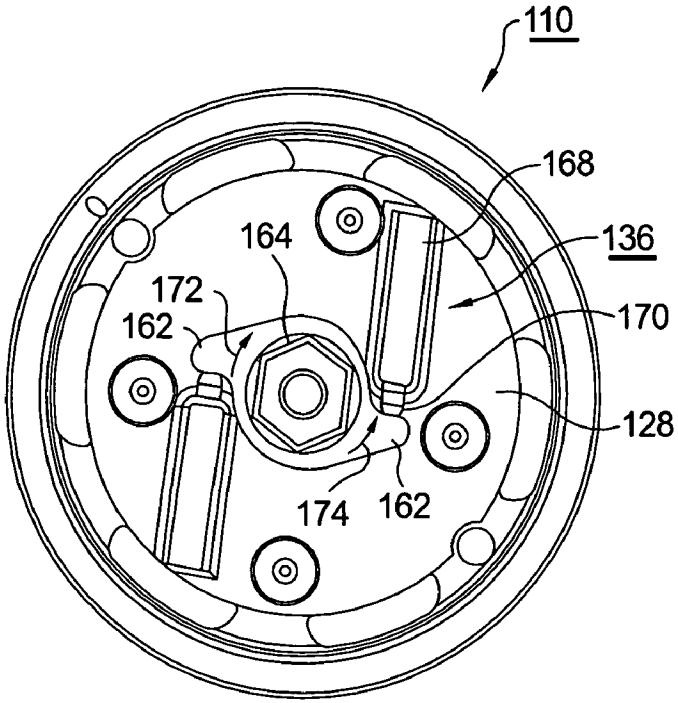
FIG. 2 is a plan view of an improved camshaft phaser showing a first embodiment of a bias spring system in accordance with the invention.

Referring now to FIGS. 2 and 3, a first embodiment 110 of an improved camshaft phaser in accordance with the invention includes an improved bias spring system 136 that replaces prior art torsional bias spring 36. System 136 comprises at least one compression spring assembly 160 disposed on cover plate 128 and a torque arm 162 mounted for rotation with a phaser rotor (not visible in FIGS. 2 and 3) as by being secured thereto by a nut 164 screwed onto a threaded stud 165 extending from a phaser mounting bolt. (A conventional target wheel, not shown, also may be mounted by obvious means onto stud 165.) Compression spring assembly 160 comprises a coil spring 166 mounted in a bore formed in a housing 168 on cover plate 128 and having a plunger 170 extending therefrom for engagement with torque arm 162. Housing 168 is rotationally formed on cover plate 128, and torque arm 162 is rotationally positioned on the rotor after the phaser is installed onto a camshaft, such that in all positions of rotor advance phase angle (advance direction 172) from the position shown in FIGS. 2 and 3, rotor motion is not influenced by bias spring system 136 because torque arm 162 is moving away from plunger 170. However, in all positions of rotor retard phase angle (retard direction 174) from the position shown in FIGS. 2 and 3, rotor motion is influenced by bias spring system 136 because torque arm 162 is engaged by spring-loaded plunger 170. In a currently preferred embodiment, the position of the rotor and torque arm shown in FIGS. 2 and 3, wherein retard motion of the torque arm is braked by bias spring system 136, corresponds to the intermediate locking position (54*b* in FIG. 1*a*) of an internal lock pin system (not visible in FIGS. 2 or 3). Further in a currently preferred embodiment, the intermediate locking position separates the rotor range of authority into a phase-advance range (58*b* in FIG. 1*a*) and a phase-retard range (58*a* in FIG. 1*a*), and a bias spring system in accordance with the invention is engageable with the rotor only within the phase-retard range.

Thus, in operation bias spring system 136 creates a time window wherein the lock pin and seat are roughly aligned for locking. Bias spring system 136 is active only in retard modes of phaser operation, wherein system 136 will always tend to return the rotor to its locking position when the retard mode is deactivated. Further, bias spring system 136 cannot cause the undesirable rotor cocking described above in prior art phasers. Preferably, improved phaser 110 is assembled and installed with the rotor in a locked position within the stator, and then torque arm 162 is secured in position against plungers 170 by nut 164.

In a presently preferred embodiment, improved bias spring system 136 comprises two torque arms 162 disposed 180° apart and two compression spring assemblies 160 disposed 180° apart, as shown in FIGS. 2 and 3, which arrangement imposes a balanced torque on the rotor in operation.

Figure 4:
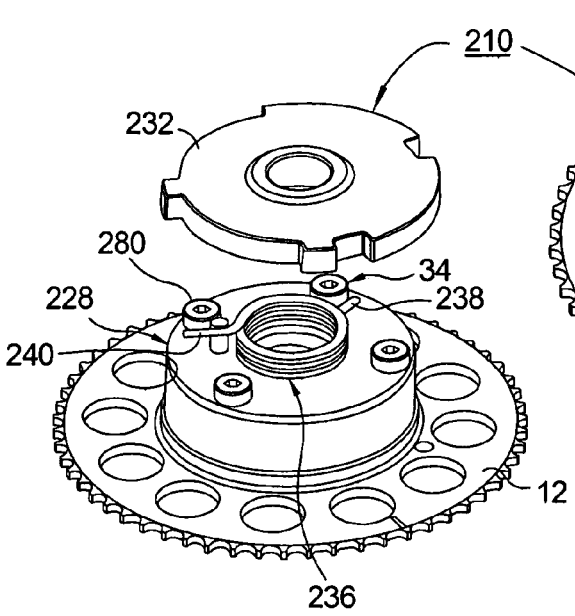
FIG. 4 is an exploded isometric view of an improved camshaft phaser showing a second embodiment of a bias spring system in accordance with the invention.
Figure 5:
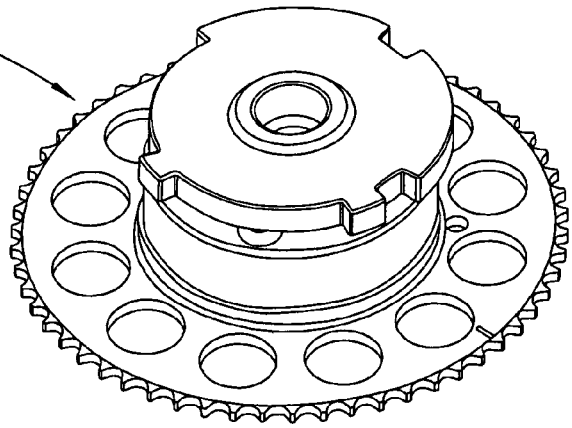
FIG. 5 is an assembled view of the phaser shown in FIG. 4.
Figure 6:
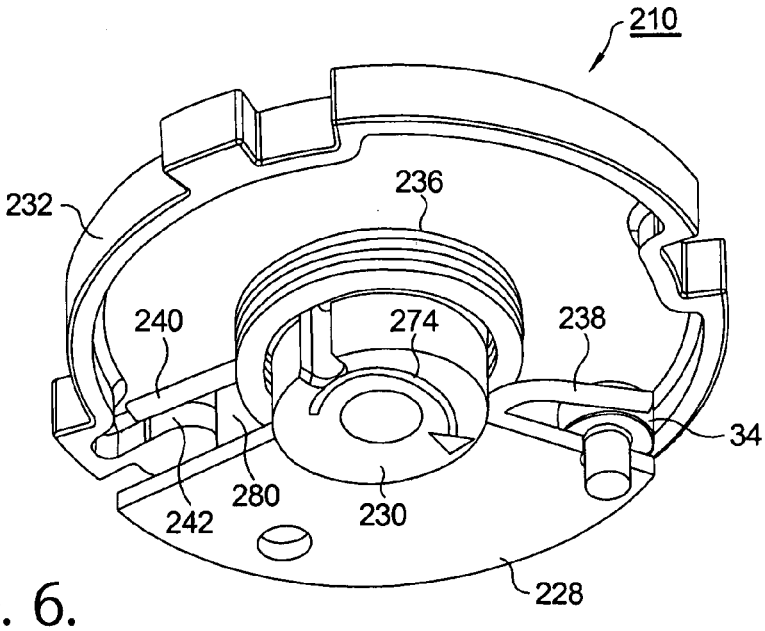
FIG. 6 is a cutaway isometric view from below of a portion of the second embodiment shown in FIGS. 4 and 5.

Referring now to FIGS. 4 through 6, a second embodiment 210 of an improved camshaft phaser in accordance with the invention includes an improved bias spring system 236 that replaces prior art torsional bias spring 36. In spring system 236, the torsion bias spring is mounted substantially as shown for prior art spring 36 in FIG. 1. Spring 236 is mounted on rotor hub extension 230, and first tang 238 engages a bolt head 34 to ground the spring to sprocket 12. However, in an improvement over prior art spring system 36, a spring stop 280 extends from cover plate 228 toward modified target wheel 232 for engaging second spring tang 240. Stop 280 is located radially inboard of target wheel modified stop 242. Further, stop 280 is located substantially coaxially with the locking position of an internal lock pin system (not visible). Thus the torsion spring as installed, and shown in FIG. 4, is grounded at both tangs 238, 240 to the cover plate and exerts no torque or cocking moment on the rotor hub extension 230 or the rotor, permitting reliable installation of the improved phaser 210 onto a camshaft end 26 during assembly of engine 27 (FIG. 1). During such installation, after the phaser is positioned on the camshaft end, target wheel 232 is installed over spring 236 and rotated counterclockwise (retard direction 274) until stop 242 engages second spring tang 240 outboard of spring stop 280. The camshaft mounting bolt (not shown) is then tightened, fixing the rotational relationship between stop 280, second tang 240, and target wheel stop 242.

The operational characteristics of improved phaser 210 are identical with those of improved phaser 110 as previously described. In operation, during all phase-advance modes (58*a* in FIG. 1*a*), target wheel stop 242 is not engaged with second tang 240, and thus spring 236 has no influence on motion of the rotor. As in first embodiment 110, in all positions of rotor retard phase angle (retard direction 274) from the position shown in FIGS. 4 and 6 rotor motion is influenced by bias spring system 236 because second tang 240 is engaged by target wheel stop 242. As noted above, the position of the target wheel and second tang shown in FIGS. 4 and 6, wherein retard motion of the rotor is braked by bias spring system 236, corresponds to the locking position of an internal lock pin system (not visible) into the stator. Thus, bias spring system 236 creates a time window where the lock pin and seat are roughly aligned for locking. Bias spring system 236 is active only in retard modes of phaser operation, wherein the spring system will always tend to return the rotor to its locking position when the retard mode is deactivated.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a camshaft phaser for advancing and retarding the timing of valves in an internal combustion engine, wherein the phaser includes a rotor having a range of authority within a stator, a cover plate disposed over the rotor and stator, and a locking pin mechanism for locking the rotor to the stator at an intermediate rotor position within the range of authority, wherein the improvement comprises a bias spring system operationally disposed between said rotor and said stator for urging said rotor toward said intermediate position from only a portion of said range of authority, wherein said intermediate rotor position separates said range of authority into a phase-advance range and a phase-retard range, and wherein said bias spring system is engageable with said rotor only within said phase-retard range.

2. In a camshaft phaser for advancing and retarding the timing of valves in an internal combustion engine, wherein the phaser includes a rotor having a range of authority within a stator, a cover plate disposed over the rotor and stator, and a locking pin mechanism for locking the rotor to the stator at an intermediate rotor position within the range of authority, wherein the improvement comprises a bias spring system operationally disposed between said rotor and said stator for urging said rotor toward said intermediate position from only a portion of said range of authority, wherein said intermediate rotor position separates said range of authority into a phase-advance range and a phase-retard range, and wherein said bias spring system is engageable with said rotor only within said phase-advance range.

3. In a camshaft phaser for advancing and retarding the timing of valves in an internal combustion engine, wherein the phaser includes a rotor having a range of authority within a stator, a cover plate disposed over the rotor and stator, and a locking pin mechanism for locking the rotor to the stator at an intermediate rotor position within the range of authority, wherein the improvement comprises a bias spring system operationally disposed between said rotor and said stator for rotationally urging said rotor during only a portion of said range of authority, wherein at least one torque arm is mounted in rotation with said rotor and for engaging said bias spring system.

4. In a camshaft phaser for advancing and retarding the timing of valves in an internal combustion engine, wherein the phaser includes a rotor having a range of authority within a stator, a cover plate disposed over the rotor and stator, and a locking pin mechanism for locking the rotor to the stator at an intermediate rotor position within the range of authority, wherein the improvement comprises a bias spring system operationally disposed between said rotor and said stator for urging said rotor toward said intermediate position from only a portion of said range of authority, wherein said bias spring system comprises at least one compression spring assembly for engaging said rotor when said rotor is in a phase advance portion of said range of authority, wherein said compression spring assembly comprises:

a) a bore formed in said cover plate wherein said at least one compression spring is disposed in said bore; and b) a plunger disposed against said compression spring for transmitting force between said rotor and said compression spring.

5. In a camshaft phaser for advancing and retarding the timing of valves in an internal combustion engine, wherein the phaser includes a rotor having a range of authority within a stator, a cover plate disposed over the rotor and stator, and a locking pin mechanism for locking the rotor to the stator at an intermediate rotor position within the range of authority, wherein the improvement comprises a bias spring system operationally disposed between said rotor and said stator for urging said rotor toward said intermediate position from only a portion of said range of authority, wherein said bias spring system comprises:

a) a torsion spring including first and second tangs, wherein said first tang is grounded to said stator;

b) said rotor having a first stop for engaging said second tang to bias said rotor in one of a phase-advance or phase-retard direction; and c) a second stop grounded to said stator for preventing engagement of said second tang with said first stop over a portion of said range of authority.

* * * * *